United States Patent [19]

Koltz

[11] 4,378,831

[45] Apr. 5, 1983

[54] COUPON WALLET AND ATTACHMENT DEVICE

[76] Inventor: Irving M. Koltz, 1329 Steeles Ave. T.W 4, Willowdale, Ontario, Canada, M2R 3N2

[21] Appl. No.: 200,331

[22] Filed: Oct. 24, 1980

[51] Int. Cl.[3] ..... A45C 11/18

[52] U.S. Cl. ..... 150/39; 215/100 R

[58] Field of Search ..... 150/39, 32; 229/74, 229/92.7, 87.5, 87 R; 206/216, 806; 215/100 R

[56] References Cited

U.S. PATENT DOCUMENTS

| | | | |
|---|---|---|---|
| 1,683,996 | 9/1928 | Snow | 150/39 X |
| 1,984,559 | 12/1934 | Wilcox | 229/74 |
| 2,187,494 | 1/1940 | Gray | 294/87.26 |
| 2,220,927 | 11/1940 | Zalkind | 229/74 |
| 3,062,366 | 11/1962 | Palmer | 206/44.12 |
| 3,064,402 | 11/1962 | Crane | 206/463 X |
| 4,008,742 | 2/1977 | Lemler | 150/39 X |
| 4,020,947 | 5/1977 | Roccaforte | 206/806 X |
| 4,055,010 | 10/1977 | Fridlund | 150/39 X |

*Primary Examiner*—Donald F. Norton
*Attorney, Agent, or Firm*—Sheldon H. Parker

[57] ABSTRACT

The invention relates to a foldable coupon holder which incorporates a set of four contiguous panels, each panel being separated by a fold line, and two sets of two contiguous panels, each panel of the two sets also being separated by a fold line. Each of the two sets of two panels overlies and is at least peripherally adhered to a pair of panels of the set of four contiguous panels. A tab closure device is incorporated to close the device when in the folded position. Groups of slits are incorporated in the two sets of two contiguous panels to form coupon retaining flaps. The slits are offset to facilitate viewing of the coupons.

The invention also relates to an attachment device for locking an article, such as the coupon holder, to another article, such as a bottle. The attachment device employs a pair of panels, each panel being contiguous with a panel of the coupon holder and each having and opening spaced from the coupon holder panel and being offset with respect to each other such that when placed upon the neck of a bottle, the openings offset from each other and grasp the bottle neck, preventing easy removal past the cap of the bottle.

16 Claims, 14 Drawing Figures

COUPON WALLET AND ATTACHMENT DEVICE

BACKGROUND OF THE INVENTION

1. Field of the Invention

This invention relates to a novel foldable coupon wallet which can be formed of paperboard or the like and can be readily used for a manufacturer's premium. This invention also relates to a novel attachment means for attaching the wallet or other containers to a bottle in a manner so as to discourage theft of the item.

2. Brief Description of the Prior Art

Coupon wallets or holders have been used for a substantial period of time and have been made of many materials. They are, however, difficult to use as give away premiums due to size configuration and attachment to an article. Attachment to bottles has been attempted through handles which employ holes and slide over the cap, resulting in many of the premiums being removed without the purchase of the manufacturer's product. Attaching the premium through use of a glue spot also allows for a substantial amount of premature removal as well as possible damage to the premium.

The instant invention provides an inexpensive, efficient and effective coupon holder which can be easily placed on bottle necks and which discourages easy removal of the holder. The unique locking means can be applied to other packages as well as the one disclosed herein.

SUMMARY OF THE INVENTION

The invention relates to a foldable coupon holder which incorporates a set of four contiguous panels, each panel being separated by a fold line, and two sets of two contiguous panels, each panel of the two sets also being separated by a fold line. Each of the two sets of two panels overlies and is at least peripherally adhered to a pair of panels of the set of four contiguous panels. A tab closure device is incorporated to close the device when in the folded position. Groups of slits are incorporated in the two sets of two contiguous panels to form coupon retaining flaps. The slits are offset to facilitate viewing of the coupons.

The invention also relates to an attachment device for locking an article, such as the coupon holder, to another article, such as a bottle. The attachment device employs a pair of panels, each panel being contiguous with a panel of the coupon holder and each having an opening spaced from the coupon holder panel and being offset with respect to each other such that when placed upon the neck of a bottle, the openings offset from each other and grasp the bottle neck, preventing easy removal past the cap of the bottle.

BRIEF DESCRIPTION OF THE DRAWINGS

The objects and advantages of the instant invention will be made clearer when read in conjunction with the drawings wherein.

DESCRIPTION OF THE PREFERRED EMBODIMENTS

Figure 1:
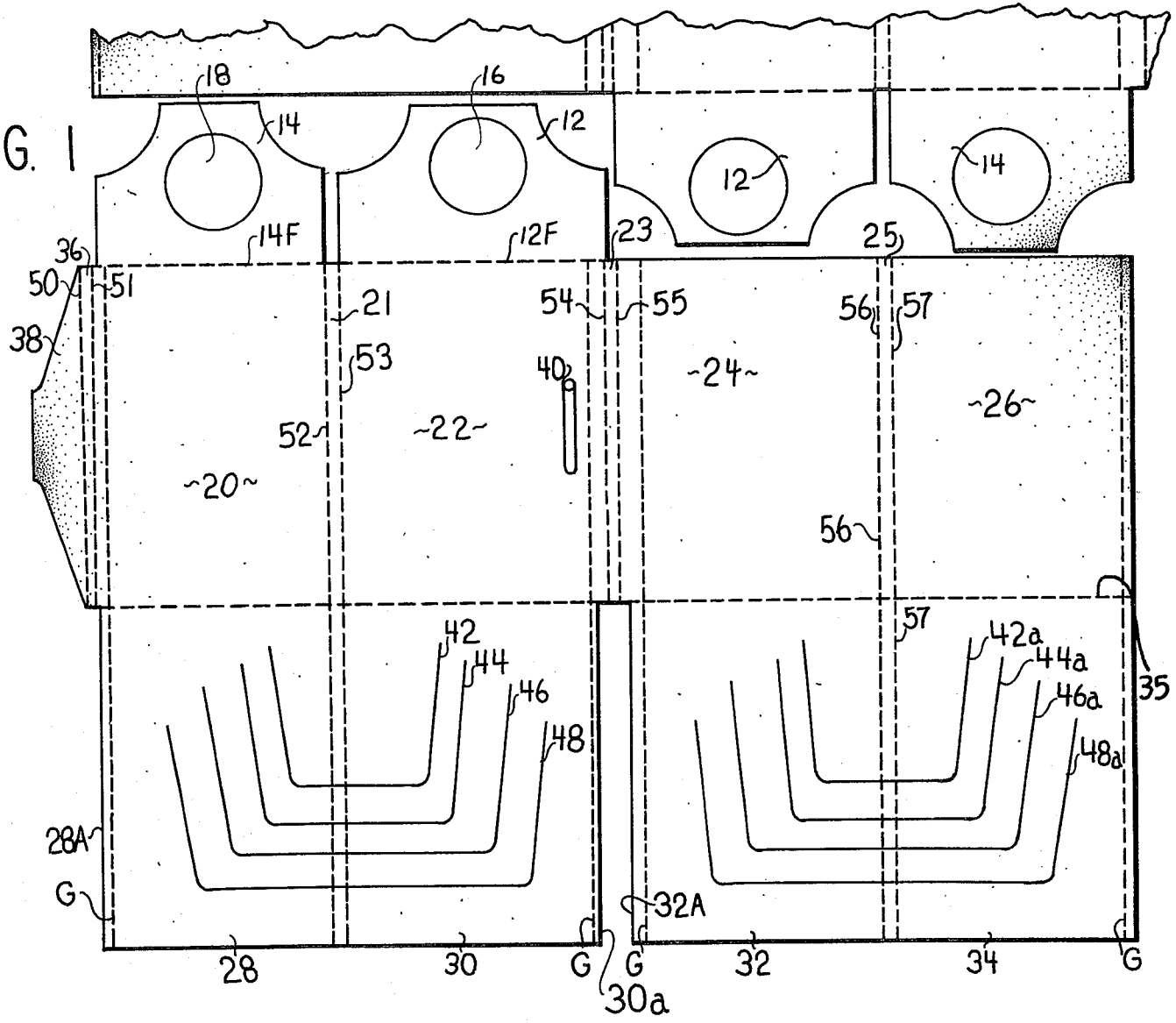
FIG. 1 is a plan view of the blank of the preferred embodiment.
Figure 2:
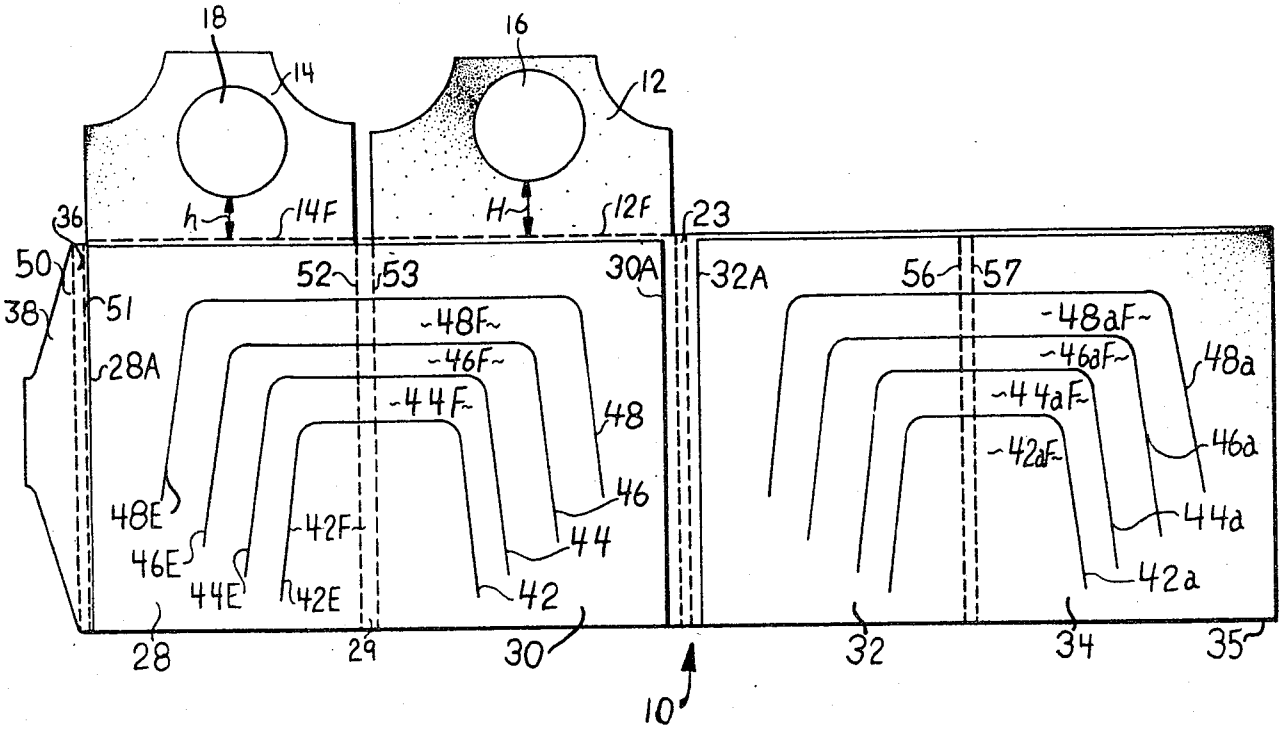
FIG. 2 is a plan view of the blank of FIG. 1 ready for use.

FIG. 1 illustrates the open blank of the instant invention for forming the coupon holder 10 as shown in FIG. 2. The blank is divided into 11 sections, forming a rectangle with extensions on three sides. The outer panels 20, 22, 24 and 26 form the back, outside, or first set, of the holder 10, while inner panels 28, 30 (second set), 32 and 34 (third set) form the inside of the holder 10. The inner panels 28, 30 and 32, 34, are provided with cut lines **42, 42*a*, 44, 44*a*, 46, 46*a*, and 48, 48*a*, which are cut during manufacture and provide the holding mechanism for the coupons, as described in FIG. 2. Contiguous with the outer panel 20, on its exterior side, is the lock flap 38. The lock flap 38 is of a design used in much of the prior art in locking containers, boxes, etc. and is used in the instant invention as the closure means. In panel 22 lying close to the fold line 54, is the lock flap slit 40 into which the lock flap 38** slides at time of closure.

Between the outer panels 20 and 22; 22 and 24; and 24 and 26 are pairs of fold lines 52 and 53; 54 and 55; and 56 and 57 respectively. Between the pairs of fold lines 52 and 53; 54 and 55; and 56 and 57, are fold areas 21, 23 and 25. These fold areas 21, 23 and 25 compensate for the thickness of the material of the blank and the coupons to be held in the holder 10. Thus, when carrying coupons, the holder 10 folds flat with ease. The fold lines 52 and 53; 56 and 57, extend into the inner panels 28 and 30; 32 and 34, along with their respective fold areas 21 and 25. The identical folding arrangement is utilized between panel 20 and lock flap 38, with fold lines 50 and 51 and fold area 38. This again allows for ease of folding during use.

At the top of panels 20 and 22 are the attachment panels 12 and 14. The panels 12 and 14 can be of any aesthetic design convenient for manufacture, and are separated from the outer panels 22 and 20 by fold lines 12F and 14F, respectively. The length of the panel 14 is greater than that of the panel 12, in order to allow for the equalization of the two attachment panels 12 and 14 when placed upon the bottle neck. The openings 16 and 18, although of the same size, have critical placement within the panels 12 and 14. The openings 16 and 18 for receiving the neck of a bottle or similar article are unevenly spaced from the edge of the panels 22 and 20 as represented by the fold lines 12F and 14F respectively. As will become more readily apparent as the disclosure continues and as illustrated in FIGS. 5, 6, 9, 10, 11 and 12, combined rotation of the panels 12 and 14 about the fold lines 12F and 14F, relative to the panels 22 and 20 will cause relative movement of the openings 16 and 18.

It is through this critical placement of the openings 16 and 18 that the locking capabilities of the instant invention are obtained. When the coupon holder 10 is placed on the neck of a bottle, the openings 16 and 18 will be forced to off set and thus lock the holder 10 to the bottle neck.

Due to the high cost of materials, it is the desire of manufacturers to cut paper costs where possible. It should be noted that on the continuous web of paper from which the blanks are cut, every other blank of the instant invention can be reversed to allow for material savings. The panels 12 and 14 of the next blank in series are positioned next to the top edge of outer panels 24 and 26, the handles of both blanks lying in a line. This method minimizes material usage.

FIG. 2 illustrates the coupon holder 10 in the open position ready for use. Glue was applied to the glue lines G of FIG. 1 and the holder 10 was folded at fold line 35, bonding the glue as well known in the art. Any of several methods of gluing can be incorporated herein and it is basically at the convenience of the manufacturer.

The cut lines 42, 42*a*, 44, 44*a*, 46, 46*a*, and 48, 48*a*, cooperate to form flaps 42F, 44F, 46F, 48F, 42AF, 44AF, 44AF, 46AF and 49AF which can be used for the storage of coupons. The angles and shapes of the cut lines 42–48*a* are not limited to those shown herein and can be of many configurations. The user is provided with eight areas in which to slip coupons and the graduated heights or positions of the ends such as 42E, 44E, 46E and 48E of the cut lines, allow for easy viewing of the coupon arrangement.

It should be noted that the adjacent inner panels 30 and 32 are provided with a space between the adjacent edges 30A and 32A. This space should preferably be at least four times greater than the thickness of the coupon holder material. When folded for use as illustrated in FIG. 2, the space between the inner panel pairs 28, 30 and 32, 34 falls outside of the fold lines 54 and 55 and fold space 23, thus preventing unneeded bulk in folding.

Figure 4:
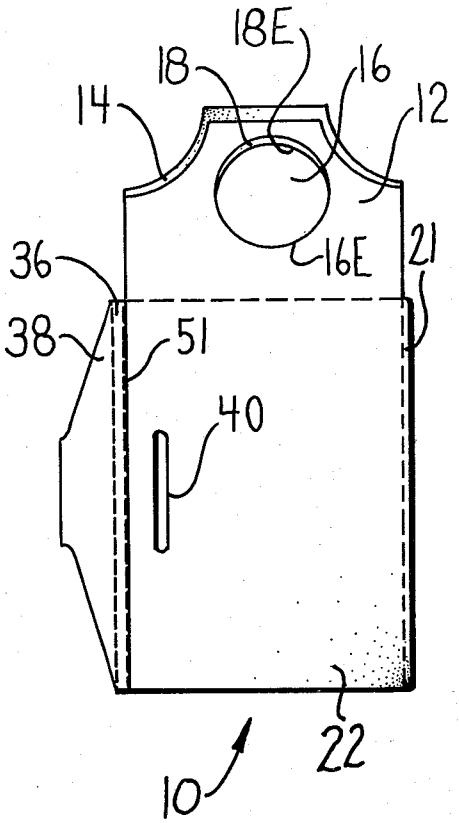
FIG. 4 is a plan view of the blank of FIG. 1 completely folded.
Figure 3:
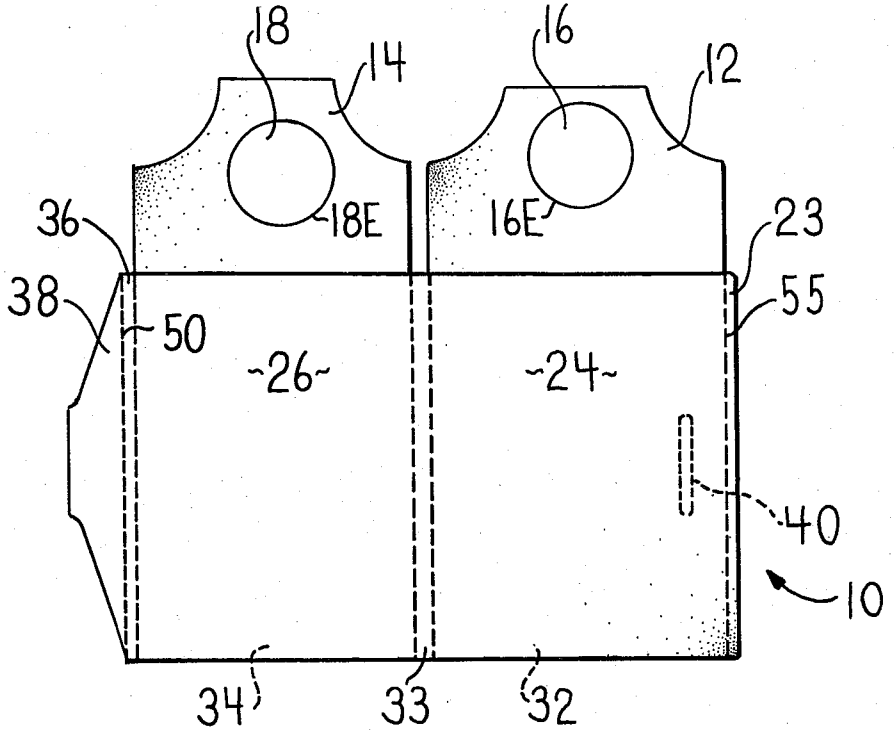
FIG. 3 is a plan view of the blank of FIG. 1 partially folded.

FIG. 3 illustrates the holder 10 folded in half at fold lines 54 and 55. The coupons have been covered and the holder is ready to be folded for the final time. FIG. 4 shows the holder 10 in the completely folded position, ready to be locked by inserting lock flap 38 into lock flap slit 40. It should be noted in this Figure that the difference in length of the handles 12 and 14 and difference in position of the openings 16 and 18 is readily apparent. The distance H from the fold line 12F to the opening 16 is greater than the distance h, from the fold line 14F to the opening 18. The offset is slight as illustrated in FIG. 2.

Figure 5:
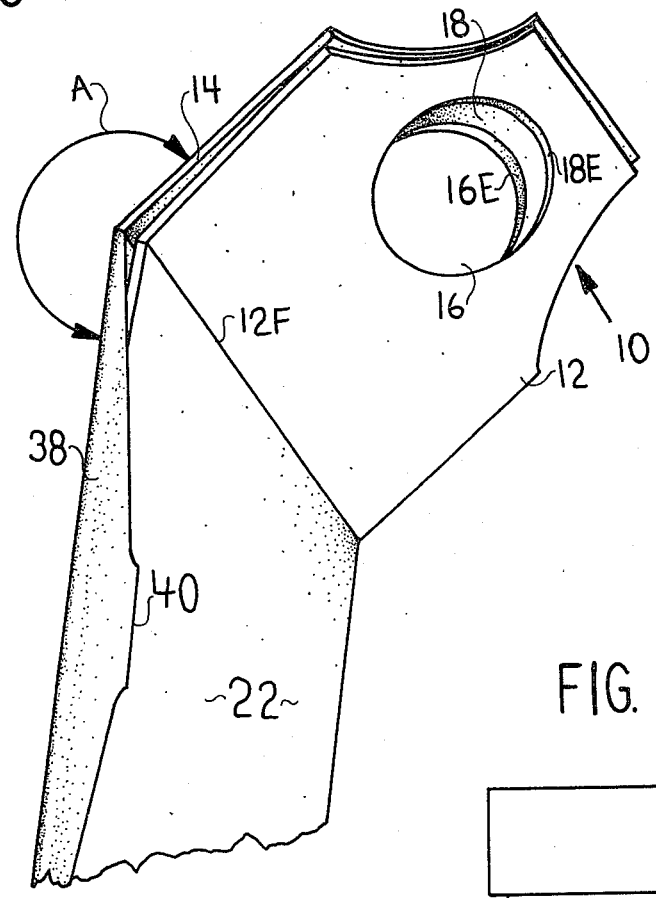
FIG. 5 is a perspective view of the preferred embodiment.

In FIG. 5, however, the holder 10 is shown at the approximate angle which it would be when placed on a bottle neck. The outer ends of the panels 12 and 14 are approximately equal and the offset between the openings 16 and 18 is near its maximum. The greater the angle A of the panels 12 and 14 relative to the panels 22, the greater the offset between the two openings 16 and 18. Thus the attachment mechanism can be utilized to lock coupon holders or other devices onto various sized bottle necks, or similar structures. As the angle approaches 90°, the edges 16E and 18E of the openings 16 and 18 align, maximizing the effective passage space, or cross sectional area, and facilitating positioning of the coupon holder on the bottle. Conversely, as the angle approaches 270°, the effective passage space, or cross sectional area, minimizes, thereby maximizing the locking effect. This change in position alters the cross sectional area 10 to 30 percent, depending on holder and bottle size.

Once positioned on the bottle neck, the holder 10 is prevented from being easily lifted off by the locking position created by the difference between the added size of the cap and the bottle neck. To place the holder 10 over the bottle cap, onto a bottle neck, the angle is reverse from that of FIG. 5, thus bringing the two openings 16 and 18 in line with each other. In order to remove the holder 10, the holder 10 must again have the angle reversed and the openings brought back in line. This action takes more time and deliberate effort than invested by most people who attempt to remove the premiums in the store without purchasing the article.

Figure 6:
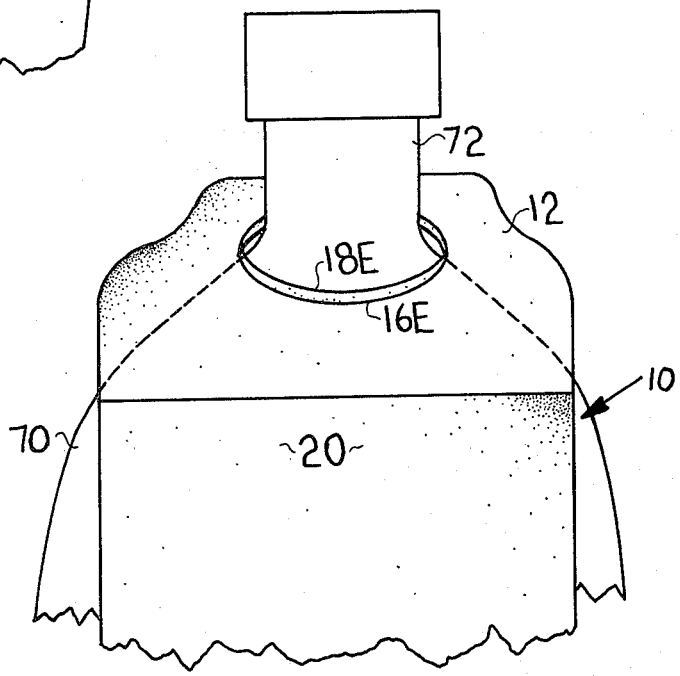
FIG. 6 is a fragmentary perspective of the preferred embodiment in use.

FIG. 6 shows the holder 10 placed on the neck of a bottle 70. The offset of the opening edges 16E and 18E is shown to clamp the bottle neck between opposing sides of the opening edges, thus locking the holder 10 onto the bottle neck 72.

As incorporated in the previous embodiment wherein the locking mechanism is attached to a coupon holder, or any other premium which it would be desirous to save, the panels 12 and 14 would be removed prior to use. The panels 12 and 14 can be removed from panels 20 and 22 by cutting or perforated lines can be provided to facilitate their removal.

Figure 7:
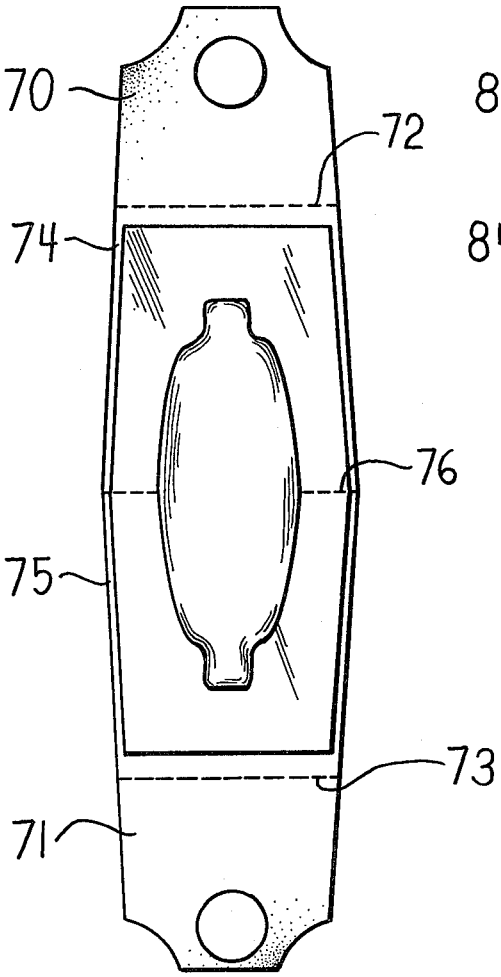
FIG. 7 is an alternate embodiment of the instant invention.

As an alternate embodiment, FIG. 7 shows the basic design of the locking panels 12 and 14 of the holder 10 employed with a display package of the type disclosed in U.S. Pat. No. 3,064,402. The panels 70 and 71 are extensions elements of the stiff supporting sheet halves 74 and 75 which correspond to elements 24 and 25 of the aforenoted patent. This embodiment allows use of the locking device of the instant invention in combination with packages for three dimensional objects, such as bottles, batteries, etc.

Figure 8:
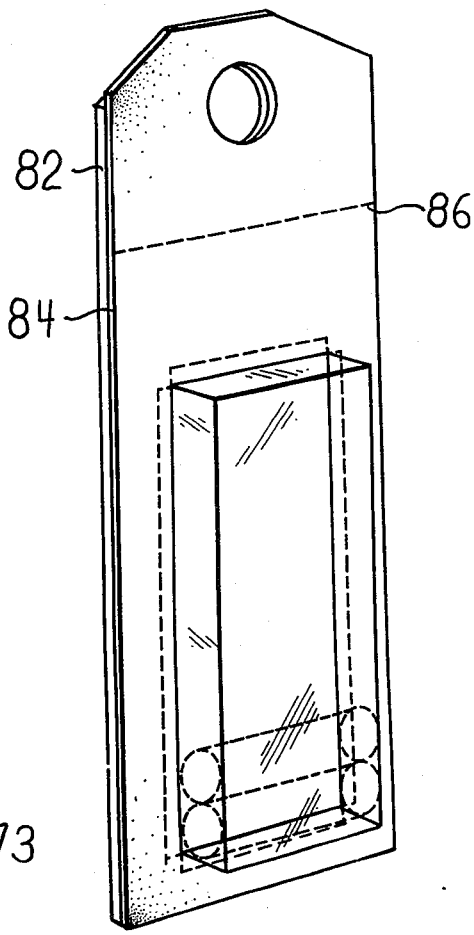
FIG. 8 is an additional embodiment of the instant invention.

FIG. 8 shows still another alternate embodiment of the instant invention. The package as disclosed in U.S. Pat. No. 3,062,366 is equipped with the locking device of the instant invention. Due to the dual handle locking system of the instant invention, two sheets or a folded sheet having two parts 82 and 84 must be employed. The sheets can be secured together at a location below the fold line 86, the location of which is based predominately on how much slippage or relative movement is required. This is described in further detail in relation to FIGS. 9 and 10.

Figure 9:
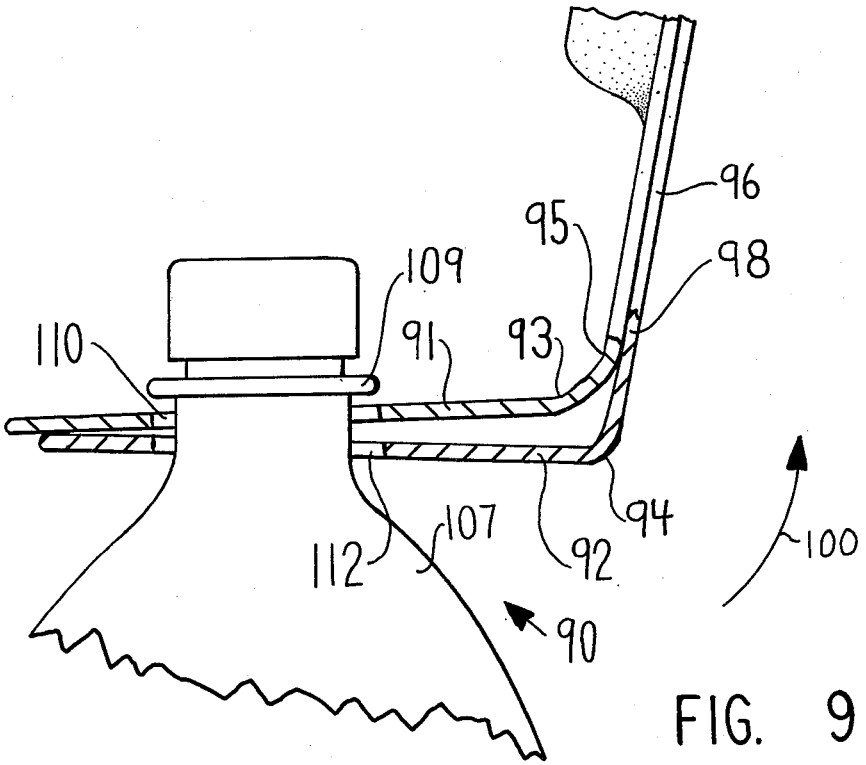
FIG. 9 fragmentary side view partly in section, of the instant invention being placed for use.
Figure 10:
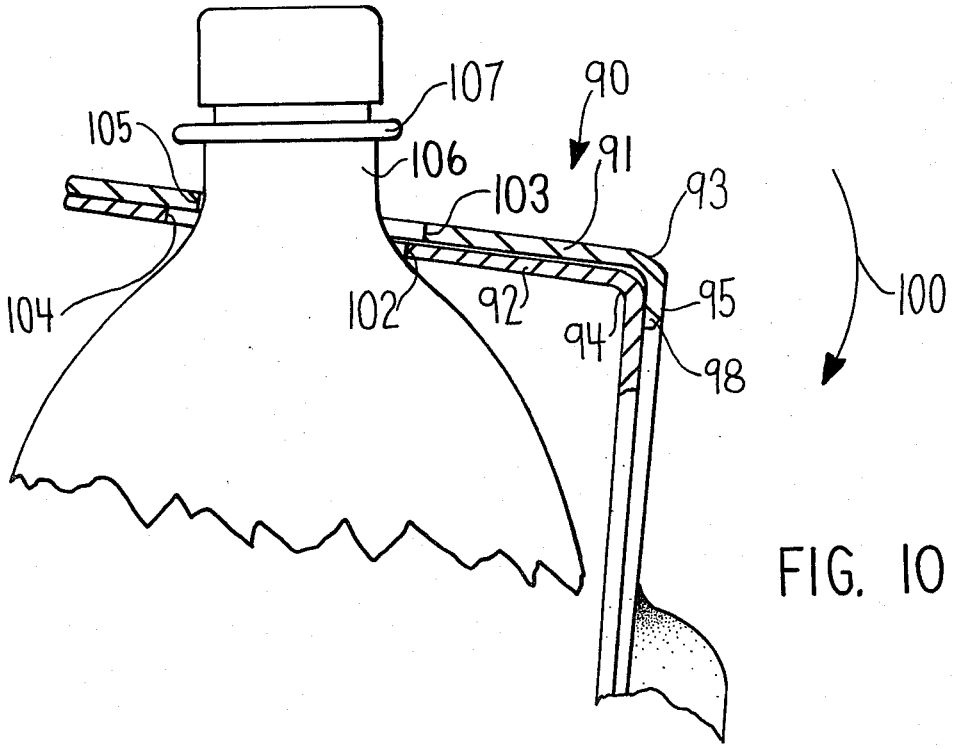
FIG. 10 is a fragmentary side view partly in section, of the instant invention of FIG. 9 in place for use.

FIGS. 9 and 10 illustrate further the bending process of the sheets or cards to form the lock mechanism. FIG. 9 shows the holder 90 in an extreme angled position for insertion of the bottle 107. In order to allow for the slippage required for the locking, glue should be placed no further toward the handles 91 and 92 than glue line 96. The configuration illustrated in FIG. 9, is of an extreme nature, showing the largest degree of rotation normally required.

The handle 91, being forced to be confined within the limitations set by angled handle 92, is preferably bent in two locations, 93 and 95. FIG. 10 shows the holder 90 in the final position, rotated about the bend or fold line 94 as indicated by arrow 100. The bend 95 of handle 91, has straightened out and both handles 91 and 92 are bent at an approximate 90 degree angle to the package 98. The openings are indicated at their edge by 102, 103, 104 and 105. The locking action as illustrated involves edges 102 and 105 pressing against the bottle neck 106 having been forced into that position by the weight of the holder 90.

Figure 11:
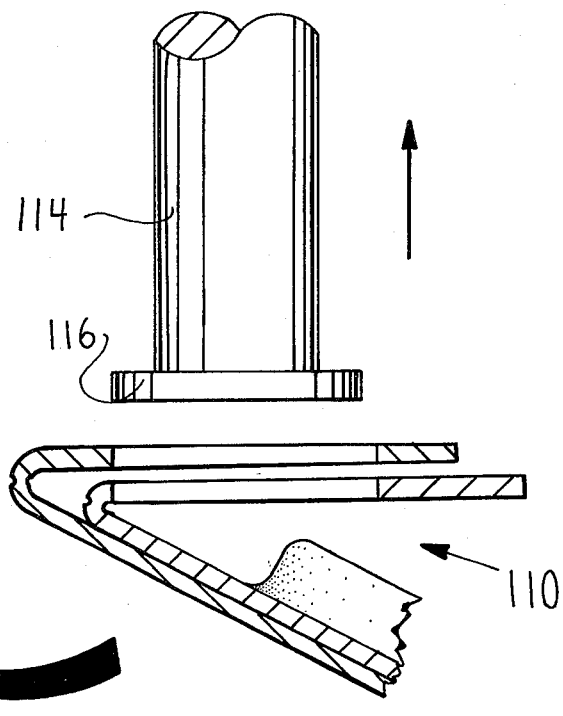
FIG. 11 is a fragmentary perspective of an alternate embodiment of the instant invention.
Figure 12:
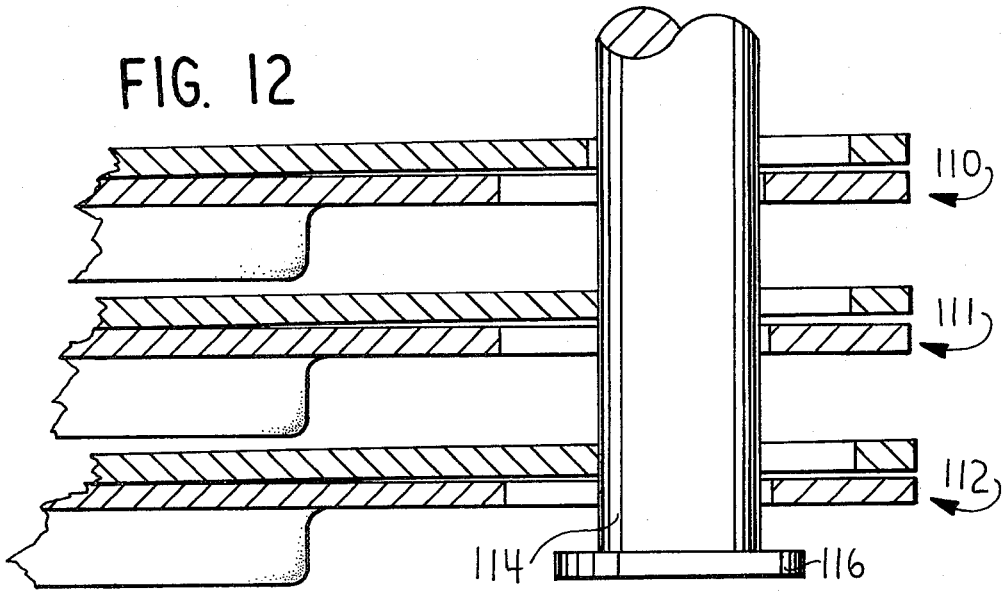
FIG. 12 is a fragmentary perspective of the embodiment of FIG. 11.

FIGS. 11 and 12 illustrate an alternate embodiment wherein attachment openings are positioned within the handles so as to lock when the holder is in a vertical position. This allows for the locking action of the handles to be combined with various packages used for display on pegs in stores. The peg 114 is equipped with a head 116 which prevents slippage of the item off the peg 114 and allows for multiple packages to be placed on the display peg.

Figure 13:
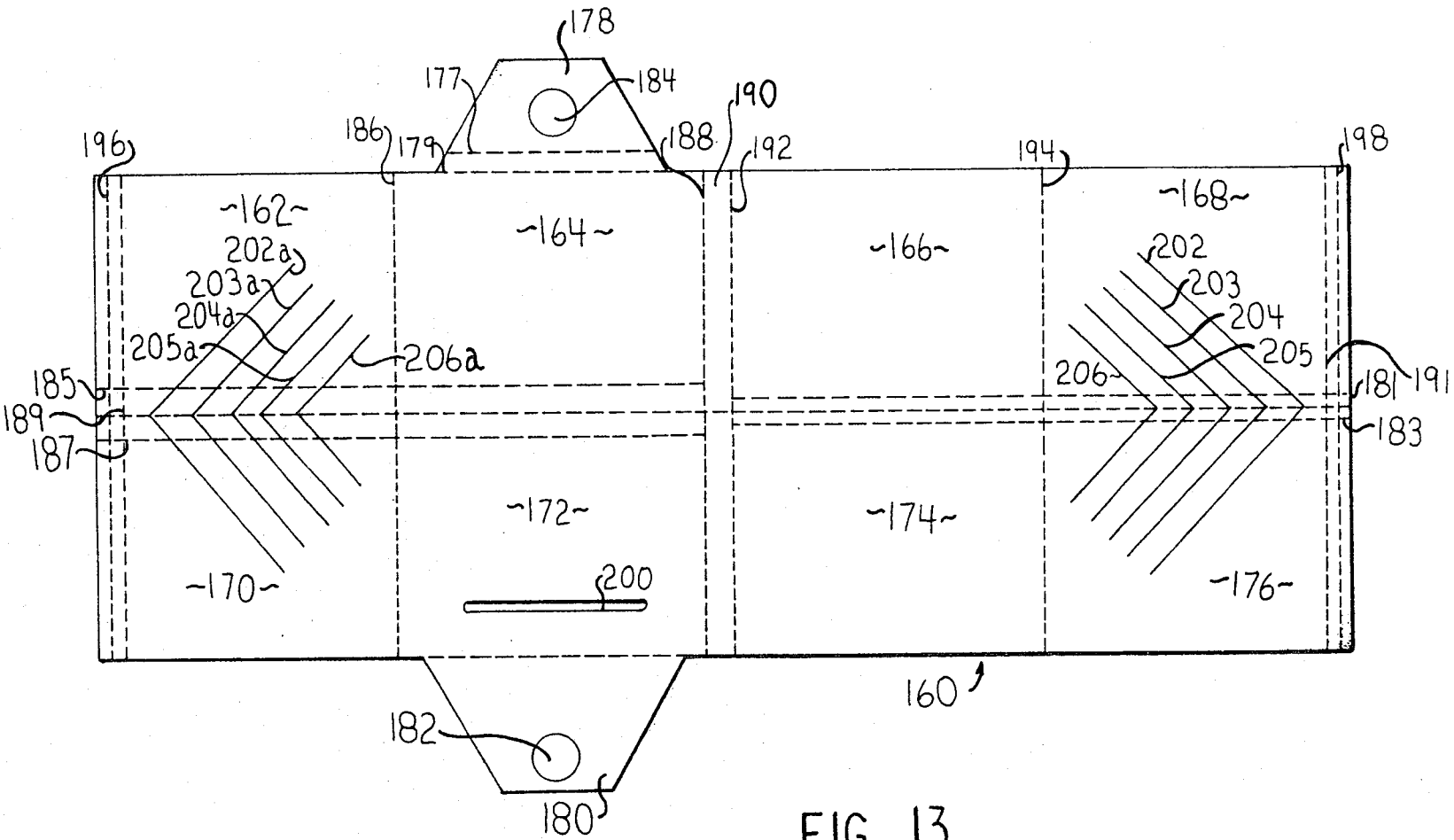
FIG. 13 is a plan view of the blank of an alternate embodiment of the instant invention.

FIG. 13 illustrates an alternate embodiment of the instant coupon holder. The blank of FIG. 13 is, as the blank of FIG. 1, formed of eight panels, 162, 164, 166, 168, 170, 172, 174 and 176, however instead of being placed essentially vertical, this embodiment is of a horizontal arrangement. The cut lines 202, 203, 204, 205, 206 and **202*a*, 203*a*, 204*a*, 205*a*, and 206*a* are positioned on the two opposite end panels 162, 170 and 168, 176. The panels 162, 170 and 168, 176 are folded over at fold lines 186 and 194 and secured through use of glue lines 196 and 198. The coupon holder 160 is, at this point, ready for use. To fold, the holder is folded at fold lines 188 and 192, with fold area 190 providing the necessary space required for smooth folds. The unit is then folded at fold lines 181, 183, and 187. It should be noted that fold area 191 is smaller than fold area 189 to allow for the inner and outer fold size differential. This last fold brings the two handles 178 and 180 together, the one handle 178 being provided with fold lines 177 and 179. The handle 180 can be folded in flat against the panel 170 and the handle 178 is then used as the closing device by being slipped into slit 200, as previously described. The handle 180** is removed by cutting or through the use of tear performations.

Figure 14:
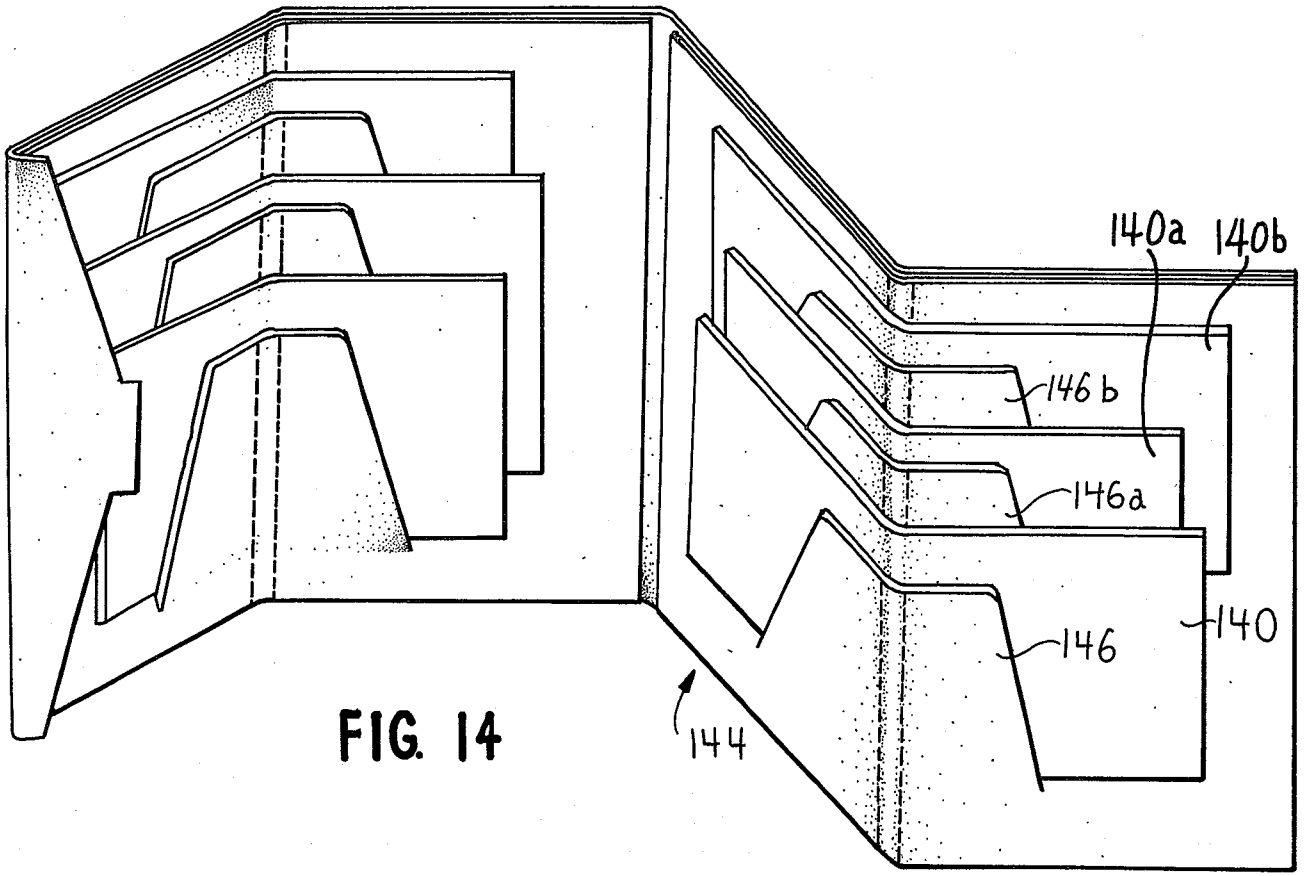
FIG. 14 is a perspective view of a blank of the type illustrated in FIG. 1, shown formed into a coupon holder and showing coupons in place.

The coupons **140, 140*a* and 140*b*, as shown in FIG. 14, are firmly held in place because of the tendency of the material of the holder 144 to retain the folded shape. Thus, the tendency toward inadvertent loss of coupons is minimized by virtue of the locking or gripping effect of the coupon retaining flaps 146, 146*a*, and 146*b* against the coupons 140, 140*a* and 140*b*.**

As previously noted, the stepped arrangement of the flaps offsets the coupons and provides for at least limited visibility of even the rear most coupons.

In order to achieve a substantial amount of relative motion of the two attachment openings as illustrated, for example in FIG. 9, the fold lines can be offset from each other with respect to their location on the card. This can be used to produce a greater amount of movement of the outboard fold relative to the inboard fold. The offset typically is not required where the two opening containing cards or panels are spaced apart a significant amount as evident in FIG. 5, due to the thickness of material between the panels 12 and 14, (including panels 28, 30, 32, 34, 24 and 26). In effect, the spacing of the adjacent fold lines 52 and 53 produces the same effect as offsetting the fold lines 72 and 73 of FIG. 7, relative to the midpoint 76.

It should be noted that the attachment panel openings need not be circular. For example, a keyhole or pear shaped opening can be used, particularly with a structure such as bottle 107, of FIG. 9, which has a ring 109 which is extremely wide relative to the diameter of the neck 106 of the bottle 107. However, a large amount of relative opening movement would be required.

What is claimed is:

1. A blank capable of being folded into a closable coupon holder, comprising:

(a) a first set of four contiguous panels, each of said panels of said first set being separated from at least one other panel by first fold means;

(b) a second set of two contiguous panels, each panel of said second set of panels being separated from at least one other panel by second fold means;

(c) a third set of two contiguous panels, each of said panels of said third set being separated from at least one other panel by third fold means;

(d) closure means, said closure means including a tab panel separated from said first set of contiguous panels by a forth fold means and a tab panel receiving slot in one panel of said first set of panels;

(e) fifth fold line means between said second set of panels and two panels of said first set of panels;

(f) sixth fold line means between said third set of panels and two panels of said first set of panels.

2. The blank of claim 1 further comprising:

(a) attachment means, said attachment means being a first attachment panel extending from a first panel of said first set of four contiguous panels and separated therefrom by a seventh fold means and a second attachment panel extending from a second panel of said first set of four contiguous panels and separated therefrom by an eighth fold means, said first attachment panel and said second attachment panel being positioned such that in the final folded condition said first attachment panel overlies said second attachment panel.

3. The blank of claim 2, wherein said first attachment panel includes a first opening and said second attachment panel includes a second opening whereby when said blank is folded in a predetermined manner, in a first position said first opening and said second opening are in cooperative positions to provide a single opening of maximum cross-sectional area and in a second position providing a single opening of minimum cross-sectional area, said second position being produced by rotating said first attachment panel to move relative to said second attachment panel in a plane substantially parallel to the plane of said second attachment panel.

4. The blank of claim 3, wherein said seventh fold means and said eighth fold means are fold lines, the distance between the center of said first opening and said seventh fold means being different from the distance between the center of said second opening and said eighth fold means, by an amount which is sufficient to cause a substantial change in the effective cross-sectional area of said single opening upon response to said rotation.

5. The blank of claim 4, wherein said substantial change in effective cross-sectional area is from about 10 to 30 percent.

6. The blank of claim 1 wherein said second set of panels and said third set of panels are spaced from each other.

7. The blank of claim 6 wherein said second set of panels and said third set of panels are each provided with a plurality of spaced slits with each slit forming a coupon holding flap, said slits being spaced so as to offset retained coupons in a significantly less than totally overlying manner.

8. The blank of claim 1 wherein each of said first, second, third and fourth fold means are pairs of fold lines spaced from one another by an amount greater than twice the thickness of the blank.

9. The structure of claim 1, wherein said first set of four contiguous rectangular panels being in a series, said second set of two contiguous rectangular panels being folded over a first pair of contiguous panels of said four contiguous rectangular panels;

said third set of two contiguous rectangular panels being folded over a second pair of contiguous panels of said four contiguous rectangular panels;

said second set of panels and third set of panels having their proximate edges spaced by an amount greater than four times the thickness of the material of said coupon holder.

10. The structure of claim 9, further comprising:

a first opening containing tab extending from a first panel of said first set of four contiguous rectangular panels and being divided from said first set of four contiguous rectangular panels by a seventh fold means;

a second opening containing tab extending from a second panel of said first set of four contiguous rectangular panels and being divided from said first set of four contiguous rectangular panels by an eighth fold means, whereby in a first position the opening of said first opening containing tab and the opening of second opening containing tab are in cooperative positions to provide a single opening of maximum cross-sectional area, and whereby in a second position being produced by rotating said a first opening containing tab and second opening containing tab about said seventh fold means and eighth fold means, relative to said first tab and said second tab which causes said first tab to move relative to said second tab in a place substantially parallel to the plane of said second tab.

11. A securable attachment device capable of being releasably secured to an elongated object having an enlarged region and a narrow region and comprising:

an article formed from foldable paper board like material, having at least one folded section including a first region and a second region substantially overlying said first region and fixed thereto, a first opening containing tab extending from edge of said first region and separated therefrom by a first fold means, a second opening containing tab extending from a first edge of said second region and separated therefrom by a second fold means and being essentially coextensive with and closely proximate to said first tab, said first fold means being parallel to but spaced from said second fold means by an amount sufficient to produce substantial relative movement of said first opening and said second opening, whereby in a first position the opening of said first opening containing tab and the opening of said second opening containing tab are in cooperative positions to provide a single opening of maximum cross-sectional area and in a second position providing a single opening of minimum cross-sectional area, said second position being produced by rotating said first region about said first fold means and second region about said second fold means, relative to said first tab and said second tab which causes said first tab to move substantially relative to said second tab in a plane substantially parallel to the plane of said second tab.

12. The securable attachment device of claim 11, wherein said securable attachment device is formed from a single sheet of material and said first fold means and said second fold means being separated by a plurality of layers of said single sheet of material.

13. The structure of claim 12 wherein said first fold means is parallel to but substantially spaced from said second fold means by an amount sufficient to produce a predetermined amount of substantial relative movement said predetermined amount being at least equal to the thickness of said material.

14. The securable attachment device of claim 11, wherein said securable attachment device is formed from a single sheet and said first fold means and said second fold means are separated by a distance greater than the thickness of said single sheet.

15. A coupon holder comprising:

(a) a first set of four contiguous rectangular panels, each of said four contiguous rectangular panels being separated from each panel with which it is contiguous by at least one fold line;

(b) a second set of two contiguous rectangular panels separated by a second set-first fold line, said second set of panels overlying a first pair of contiguous panels of said first set of panels and being adhered thereto along peripherial regions, said second set-first fold line separating said two contiguous rectangular panels of said second set of panels and overlying a fold line between said first pair of contiguous panels of said first set of panels;

(c) a third set of two contiguous rectangular panels separated by a third set-first fold line, said third set of panels overlying a second pair of contiguous panels of said first set of panels and being adhered thereto along peripheral regions, said third set-first fold line separating said two contiguous rectangular panels of said third set of panels overlying the fold line between said second pair of contiguous panels of said first set of panels;

(d) a plurality of essentially equally spaced slits in each of said second set of panels and said third set of panels, each of said plurality of slits being approximately evenly bisected respectively by said second set-first fold line and said third set-first fold line, said slits being contoured to form a coupon holding flap.

16. A coupon holder comprising:

(a) a first set of two contiguous rectangular panels, each of said two contiguous rectangular panels being separated from each panel with which it is contiguous by a first pair of spaced fold lines;

(b) a second set of two contiguous rectangular panels separated from each panel with which it is contiguous by a second pair of spaced fold lines;

said second set of panels overlying said first set of two contiguous rectangular panels, and fixed thereto along peripheral regions, (c) a plurality of essentially equally spaced "U" shaped slits positioned in said second set of two contiguous rectangular panels, each of said plurality of slits being approximately evenly bisected respectively by said second pair of spaced fold lines, said slits being contoured to form a coupon holding flap.

* * * * *